US005931331A

United States Patent [19]

Kirk et al.

[11] Patent Number: 5,931,331

[45] **Date of Patent: *Aug. 3, 1999**

[54] EASY-OPEN MECHANISM FOR CAN END

[75] Inventors: William A. Kirk; Michael C. Calhoun; David M. Hoffman, all of Massillon; Jeffrey McFarland, Canton, all of Ohio

[73] Assignee: Crown Cork & Seal Technologies Corporation, Alsip, Ill.

[ * ] Notice: This patent issued on a continued prosecution application filed under 37 CFR 1.53(d), and is subject to the twenty year patent term provisions of 35 U.S.C. 154(a)(2).

[21] Appl. No.: 08/805,204

[22] Filed: Feb. 27, 1997

[51] Int. Cl.[6] ..... B65D 41/32

[52] U.S. Cl. ..... 220/269; 220/906

[58] Field of Search ..... 220/269, 270, 220/271, 272, 906

[56] References Cited

U.S. PATENT DOCUMENTS

| | | | |
|---|---|---|---|
| 3,843,011 | 10/1974 | Perry . | |
| 3,967,752 | 7/1976 | Cudzik . | |
| 4,051,976 | 10/1977 | Perry . | |
| 4,062,471 | 12/1977 | Perry . | |
| 4,084,721 | 4/1978 | Perry . | |
| 4,320,850 | 3/1982 | Drolen, Jr. . | |
| 4,387,827 | 6/1983 | Ruemer, Jr. . | |
| 4,402,421 | 9/1983 | Ruemer, Jr. . | |
| 4,465,204 | 8/1984 | Kaminski et al. . | |
| 4,605,141 | 8/1986 | Won . | |
| 4,733,793 | 3/1988 | Moen | 220/269 |
| 4,901,880 | 2/1990 | Tatham et al. | 220/269 |
| 4,930,658 | 6/1990 | McEldowney | 220/269 |
| 5,064,087 | 11/1991 | Koch | 220/269 |
| 5,129,541 | 7/1992 | Voigt et al. | 220/269 |
| 5,375,729 | 12/1994 | Schubert | 220/269 X |
| 5,692,636 | 12/1997 | Schubert | 220/269 X |

FOREIGN PATENT DOCUMENTS

| | | | |
|---|---|---|---|
| 2553835 | 6/1976 | Germany | 220/269 |

*Primary Examiner*—Stephen K. Cronin
*Assistant Examiner*—Nathan Newhouse
*Attorney, Agent, or Firm*—Woodcock Washburn Kurtz Mackiewicz & Norris LLP

[57] ABSTRACT

A can end having an improved pour-type ecology opening mechanism includes a conventional can end wall that contains a score line that defines a displaceable panel. The score line includes an initial design rupture point, a radiused portion having a first tangent point and a second tangent point, and a main portion that terminates at a final transition point. The can end further includes a tab having a liftable heel portion and a tab nose portion, with the tab nose portion being positioned to apply downward pressure to the panel at a pressure point on the displaceable panel when the heel portion is lifted. The tab has a center line that is coincident with a radius of said can end wall. Advantageously, the pressure point is positioned a distance, taken in the direction of the center line, from the second tangent point of the radiused portion that is selected to prevent a buildup of force that would otherwise hasten propagation of separation along the main portion of the score. This prevents splashing of the beverage during opening of the can by the consumer.

41 Claims, 1 Drawing Sheet

EASY-OPEN MECHANISM FOR CAN END

BACKGROUND OF THE INVENTION

1. Field of the Invention

This invention relates broadly to the field of easy open liquid containers for beverages and the like. More specifically, it relates to an improved easy opening ecology can end mechanism that is advantageous in that it minimizes splashing of the beverage during opening of the can by a consumer.

2. Description of the Prior Art and Related Technology

An easy open end, for the purposes of this document, may be defined as a can end which is designed to be opened by a consumer without using a can opener or similar tool. A pour-type can end is defined as a can end of the type which defines a pour spout opening after it has been opened to enable the consumer to pour a beverage or other liquid from the can assembly in a controlled manner. An ecology type easy open can end is defined as one where the tab stays attached to the can after opening, to prevent littering.

Pour-type can ends typically include a displaceable end panel portion which, through force that is applied by pulling on a gripping-tab that is connected to the displaceable portion, is peeled back from the end panel along a score line to define the pouring spout. An example of a conventional pour-type can end is depicted in FIG. 1. A wall 10 of a can end is shown having a displaceable panel 12 defined therein by a score line 14. As shown in FIG. 1, the score line 14 comprises multiple portions, each of which has a different radius of curvature. The first portion 25 of the score line 14 extends from point 24, which is the point on the score line that is directly ahead of the rivet 20, to point 30. The second portion 31 of the score line 14, which is an intermediate portion, extends from point 30 to point 32. The third portion of the score line 14, which is the main portion 33, extends from point 32 to point 34, where the score line terminates. Thus, point 30 is the point on the score line 14 where the first portion 25 and the intermediate portion 31 of the score line intersect, while point 32 is the point where the intermediate portion 31 and the main portion 33 of the score line intersect. As also shown in FIG. 1, the first portion 25 of the score line 14 is substantially straight, having a radius of curvature of essentially infinity. The intermediate portion 31 has a first radius of curvature. The main portion 33 is formed from several sections having different radii of curvature. In any event, as shown in FIG. 1, the section of the main portion 33 adjacent intersection point 32 has a radius of curvature that is greater than the radius of curvature of the intermediate portion 31. As also shown in FIG. 1, the intermediate portion 31 of the score line 14 is preferably tangent to the first portion 25 and the main portion 33 at the intersection points 30 and 32, respectively. As is typical in this area of technology, a secondary antifracture score line 16 that is roughly parallel to score line 14 is provided on the displaceable panel 12 to reduce stress imposed on the score 14 during processing and handling. A tab 18 that is connected to wall 10 via a rivet 20 includes a forward facing tab nose 28 that is intended to apply a downward force to displaceable panel 12 at a pressure point 26 when a rearward facing heel 22 of the tab 18 is lifted, as may readily be envisioned by viewing FIG. 1. As the heel 22 continues to rise, it ruptures the score 14 at the point 24 that is directly ahead of the rivet 20. The score 14 then ruptures along its bottom as viewed in FIG. 1, along portion 25 to the intersection point 30 of the radiused lower left portion of the score 14.

As force is applied increasingly at the pressure point 26 by the tab nose 28, the score begins to separate along the radiused curve at the lower left in FIG. 1, that is from the first intersection point 30 to the second intersection point 32. As may be seen in FIG. 1, the pressure point 26 is positioned forwardly (i.e., in the direction of a center line 38 of the tab 18 as shown in FIG. 1) of the second intersection point 32 by a distance $D_1$, which in one sample known to the inventor has a value of 0.0287 inches. In addition, the pressure point 26 is positioned to the right of the second intersection point 32 (i.e. along an axis that is perpendicular to the center line 38) by a distance $D_2$, which in the sample referred to above is about 0.1172 inches or greater. These distances are large enough that a buildup of significant force is required at the pressure point 26 in order to advance separation of the score 14 beyond the second intersection point 32. When this separation does occur, it does so with a release of force that is large enough that the score 14 will separate nearly instantaneously all the way about the forward portion of the panel 12 to the final transition point 34. As it separates, the panel 12 folds downwardly about a fold line 36 into the interior of the can body. The plane along which the panel 12 moves is indicated by reference numeral 40 in FIG. 1, and this plane is positioned at an angle $\alpha$ with respect to the centerline 38, which is in the sample referred to above about 18.2 degrees. If the panel 12 folds downwardly to a 90 degree angle, it will extend into the interior of the can body by a distance $D_3$.

When a can body is filled with a soft drink or other liquid, a head space of air is typically left at the top of the can body before the can end is installed. In more modern plastic containers, the head space must be minimized. When a can end such as that described above with reference to FIG. 1 is used on a can that has minimal head space, the near instantaneous separation of the score 14 described above results in the panel 12 snapping forcefully down into the beverage, which can cause the beverage to splash. Obviously, this is a problem that needs to be addressed.

It is clear that a need exists for an improved easy open mechanism for a can end that is attractive and convenient for the consumer to use, and that minimizes the potential for splashing during opening, yet maintains sufficient strength and integrity for processing and shipping.

SUMMARY OF THE INVENTION

It is clear that a need exists for an improved easy open mechanism for a can end that is attractive and convenient for the consumer to use, and that minimizes the potential for splashing during opening.

In order to achieve the above and other objects of the invention, a can end having an improved pour-type ecology opening mechanism, includes, according to a first aspect of the invention, a can end wall; a score line in the can end wall that defines a displaceable panel, the score line having an initial design rupture point, a radiused portion having a first intersection point and a second intersection point, and a main portion that terminates at a final transition point; a tab having a liftable heel portion and a tab nose portion, the tab being fastened to the can end wall at a location that is intermediate the heel portion and the tab nose portion, the tab nose portion being positioned to apply downward pressure to the panel at a pressure point on the displaceable panel when the heel portion is lifted, the tab having a center line that is coincident with a radius of the can end wall; and wherein the pressure point is positioned a distance $D_4$, taken in the direction of the center line, from the second intersection point of the radiused portion, and wherein the distance $D_4$ is within a range of about minus 0.025 inches to about plus 0.025 inches, whereby a buildup of force that would otherwise hasten propagation of separation along the main portion of the score is avoided.

According to a second aspect of the invention, a can end having an improved pour-type ecology opening mechanism, includes a can end wall; a score line in the can end wall that defines a displaceable panel, the score line having an initial design rupture point, a radiused portion having a first intersection point and a second intersection point, and a main portion that terminates at a final transition point; a tab having a liftable heel portion and a tab nose portion, the tab being fastened to the can end wall at a location that is intermediate the heel portion and the tab nose portion, the tab nose portion being positioned to apply downward pressure to the panel at a pressure point on the displaceable panel when the heel portion is lifted, the tab having a center line that is coincident with a radius of the can end wall; and a fold line about which the panel folds with respect to the can end wall during opening, the fold line being positioned so that the panel folds within a plane that is oriented at an angle $\beta$ with respect to the centerline, and wherein the angle $\beta$ is within the range of about 45 degrees to about 90 degrees.

According to a third aspect of the invention, a can end having an improved pour-type ecology opening mechanism includes a can end wall; a score line in the can end wall that defines a displaceable panel, the score line having an initial design rupture point, a radiused portion having a first intersection point and a second intersection point, and a main portion that terminates at a final transition point; a tab having a liftable heel portion and a tab nose portion, the tab being fastened to said can end wall at a location that is intermediate the heel portion and the tab nose portion, the tab nose portion being positioned to apply downward pressure to the panel at a pressure point on the displaceable panel when the heel portion is lifted, the tab having a center line that is coincident with a radius of the can end wall; and wherein the pressure point is located a distance $D_5$, taken along a line that is perpendicular to the centerline, from the first intersection point of the radiused portion and wherein $D_5$ is within the range of 0.040 inches to about 0.140 inches.

These and various other advantages and features of novelty which characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

DETAILED DESCRIPTION OF THE PREFERRED EMBODIMENT(S)

Figure 2:
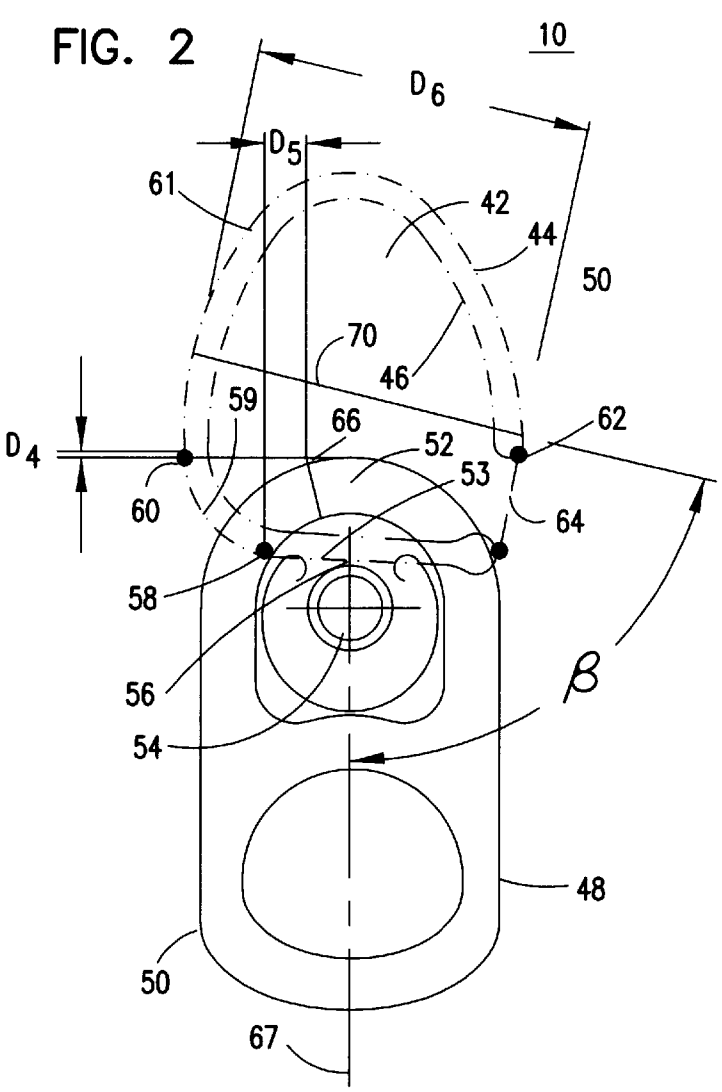
FIG. 2 is a top elevational view of a pour-type ecology can opening mechanism that is constructed according to a preferred embodiment of the invention.

Referring now to the drawings, wherein like reference numerals designate corresponding structure throughout the views, and referring in particular to FIG. 2, a can end having an improved pour-type ecology opening mechanism that is constructed according to the preferred embodiment of the invention includes a can end wall 10, and a score line 44 that is defined in the can end wall 10 and that defines a displaceable panel 42. Score line 44 is of a constant depth and has an initial design rupture point 56.

As shown in FIG. 2, the score line 44 comprises multiple portions, each of which has a different radius of curvature. The first portion 53 extends from rupture point 56, which is the point on the score line that is directly ahead of the rivet 54, to point 58. The second portion 59 of the score line 44, which is an intermediate portion, extends from point 58 to point 60. The third portion 61, which forms the main portion of the score line 44, extends from point 60 to point 62, which is the rightmost point on FIG. 2, where the score line terminates. Thus, point 58 is the point on the score line 44 where the first portion 53 and the intermediate portion 59 of the score line intersect, while point 60 is the point where the intermediate portion and the main portion 61 of the score line intersect. As also shown in FIG. 2, the first portion 53 of the score line 44 is substantially straight, having a radius of curvature of essentially infinity. The intermediate portion 59, which extends from intersection point 58 to intersection point 60, has a first radius of curvature. The main portion 61, which extends away from intersection point 60, is formed from several sections having different radii of curvature. In any event, as shown in FIG. 2, the section of the main portion 61 adjacent intersection point 60 has a radius of curvature that is greater than the radius of curvature of the intermediate portion 59. As also shown in FIG. 2, the intermediate portion 59 of the score line 44 is preferably tangent to the first portion 53 and the main portion 61 at the intersection points 58 and 60, respectively. A supplemental score 46 is also defined on the displaceable panel 42, for reasons hat have previously been discussed.

The embodiment of the invention shown in FIG. 2 also includes a tab 48 that has a liftable heel portion 50 and a tab nose portion 52. The tab 48 is fastened to the can end wall 10 by means of a rivet 54 at a location that is between the heel portion 50 and the tab nose portion 52. The tab nose portion 52 is positioned to apply downward pressure to the panel 42 at a pressure point 66 on the displaceable panel 42 when the heel portion 50 is lifted. The tab 48 has a center line 67 that is coincident with a radius of said can end wall when the tab 48 is properly positioned.

Figure 1:
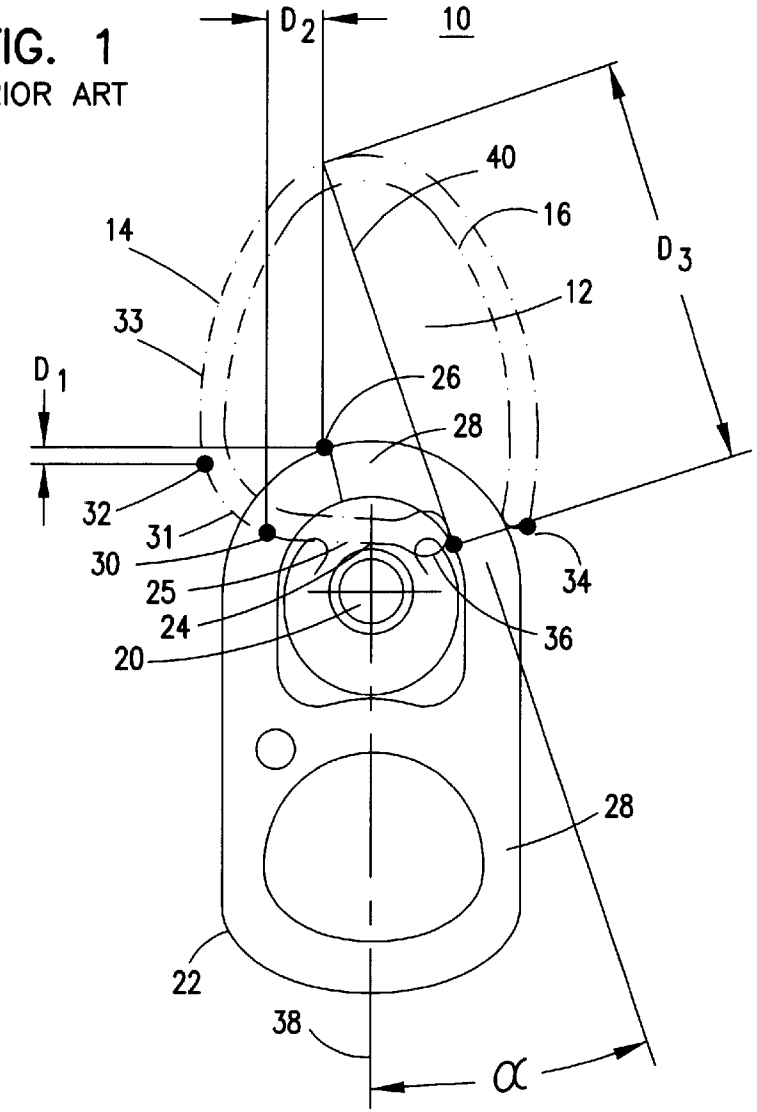
FIG. 1 PRIOR ART
FIG. 1 is a top elevational view of a pour-type ecology can opening mechanism of the type that is in conventional use.

According to one important aspect of the invention, the pressure point 66 is positioned a distance $D_4$, taken in the direction of the center line 67, from the second intersection point 60 of the radiused portion 59 that is within a range of about minus 0.025 inches to about plus 0.025 inches. This has been found to prevent a buildup of force, of the magnitude discussed above with reference to FIG. 1, that would otherwise hasten propagation of separation along the main portion of the score and cause splashing. Instead, a can end constructed according to the invention opens more slowly and gradually, without splashing the contents of the container on the person who is opening the container. More preferably, the distance $D_4$ is within the range of about minus 0.015 inches to about plus 0.015 inches. Most preferably, the distance $D_4$ is about 0.0085 inches.

According to another important aspect of the invention, the pressure point 66 is further located a distance $D_5$, taken along a line that is perpendicular to the centerline, from said first intersection point 58 of the radiused portion 59 that is within the range of 0.040 inches to about 0.140 inches. This also tends to reduce force buildup that might hasten separation of the score. More preferably, the distance $D_5$ is within the range of about 0.050 inches to about 0.100 inches, and most preferably the distance $D_5$ is about 0.083 inches.

According to another feature of the invention, the mechanism includes a fold line 64 about which the panel 42 folds with respect to said can end wall 10 during opening. Fold line 64 is preferably positioned so that the panel 42 folds within a plane that is oriented at an angle β with respect to the centerline 67, and the angle β is preferably within the range of about 45 degrees to about 90 degrees. More preferably, angle β is further within the range of about 60 degrees to about 85 degrees, and most preferably the angle β is about 80 degrees. As previously discussed in connection with distance $D_3$ shown in FIG. 1, if the panel 42 shown in FIG. 2 folds downwardly to a 90 degree angle, it will extend into the interior of the can body by a distance $D_6$.

The length of the fold line also contributes to the speed at which the can end opens, but is considered to be less a factor than those mentioned above.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A can end having an improved pour-type ecology opening mechanism, comprising:

a can end wall;

a score line in said can end wall that defines a displaceable panel, said score line having (i) a first portion on which an initial design rupture point is disposed, (ii) a main portion that terminates at a final point, said main portion comprising a first section having a first curvature, and (iii) an intermediate portion that extends from said first portion to said first section of said main portion, said intermediate portion having a second curvature defined by a first radius of curvature that is constant throughout said intermediate portion, said first curvature being different from said second curvature, whereby said curvature changes between said first section of said main portion and said intermediate portion, said intermediate portion intersecting said first section of said main portion at a first intersection point defined by said change in curvature;

a tab having a liftable heel portion and a tab nose portion, said tab being fastened to said can end wall at a location that is intermediate said heel portion and said tab nose portion, said tab nose portion being positioned to apply downward pressure to said panel at a pressure point on said displaceable panel when said heel portion is lifted, said tab having a center line that is substantially coincident with a radius of said can end wall; and wherein said pressure point is positioned a distance $D_4$, taken in the direction of said center line, from said first intersection point, and wherein the distance $D_4$ is within a range of about minus 0.025 inches to about plus 0.025 inches, whereby a buildup of force that would otherwise hasten propagation of separation along said main portion of said score is avoided.

2. A can end according to claim 1, wherein said first portion of said score line is substantially straight.

3. A can end according to claim 1, wherein said intermediate portion of said score line is tangent to said first section of said main portion of said score line at said first intersection point.

4. A can end according to claim 1, wherein said score line has a substantially constant depth.

5. A can end according to claim 1, wherein the distance $D_4$ is within the range of about minus 0.015 inches to about plus 0.015 inches.

6. A can end according to claim 5, wherein the distance $D_4$ is about 0.0085 inches.

7. A can end according to claim 1, further comprising a fold line about which said panel folds with respect to said can end wall during opening, and wherein said fold line is positioned so that said panel folds within a plane that is oriented at an angle β with respect to said centerline, and wherein the angle β is within the range of about 45 degrees to about 90 degrees.

8. A can end according to claim 7, wherein said angle β is further within the range of about 60 degrees to about 85 degrees.

9. A can end according to claim 8, wherein said angle β is about 80 degrees.

10. A can end according to claim 1, wherein the distance $D_4$ is no greater than about 0.015 inches.

11. A can end according to claim 10, wherein the distance $D_4$ is about 0.0085 inches.

12. A can end according to claim 1, wherein said initial portion has a third curvature, said third curvature being different from said second curvature, whereby said curvature of said score line changes between said initial portion and said intermediate portion, and wherein said intermediate portion intersects said initial portion at a second intersection point defined as the point at which said curvature changes from said second curvature to said third curvature;

wherein said pressure point is further located a distance $D_5$, taken along a line that is perpendicular to said centerline, from said second intersection point, $D_5$ being within the range of 0.040 inches to about 0.140 inches.

13. A can end according to claim 12, wherein the distance $D_5$ is within the range of about 0.05 inches to about 0.100 inches.

14. A can end according to claim 13, wherein the distance $D_5$ is about 0.083 inches.

15. A can end according to claim 1, further comprising a fold line about which said panel folds with respect to said can end wall during opening, and wherein said fold line is positioned so that said panel folds within a plane that is oriented at an angle β with respect to said centerline, and wherein the angle β is within the range of about 45 degrees to about 90 degrees.

16. A can end according to claim 15, wherein said angle β is within the range of about 60 degrees to about 85 degrees.

17. A can end according to claim 16, wherein said angle β is about 80 degrees.

18. A can end according to claim 1, wherein said score line first portion has a third curvature, said third curvature being different from said second curvature, whereby said curvature changes between said first portion and said intermediate portion, and wherein said intermediate portion intersects said first portion at a second intersection point defined by said change in curvature between said first portion and said intermediate portion, wherein said pressure point is further located a distance $D_5$, taken along a line that is perpendicular to said centerline, from said second intersection point and wherein $D_5$ is within the range of 0.040 inches to about 0.140 inches.

19. A can end according to claim 18, wherein the distance $D_5$ is within the range of about 0.05 inches to about 0.100 inches.

20. A can end according to claim 19, wherein the distance $D_5$ is about 0.083 inches.

21. A can end according to claim 18, further comprising a fold line about which said panel folds with respect to said can end wall during opening, and wherein said fold line is positioned so that said panel folds within a plane that is oriented at an angle β with respect to said centerline, and wherein the angle β is within the range of about 45 degrees to about 90 degrees.

22. A can end according to claim 21, wherein said angle β is further within the range of about 60 degrees to about 85 degrees.

23. A can end according to claim 22, wherein said angle β is about 80 degrees.

24. A can end having an improved pour-type ecology opening mechanism, comprising:

a can end wall;

a score line in said can end wall that defines a displaceable panel, said score line having (i) a first portion on which an initial design rupture point is disposed, said first portion being substantially straight so as to have substantially minimal curvature, (ii) a main portion that terminates at a final point, and (iii) an intermediate portion that extends from said first portion to said main portion, said intermediate portion being curved, whereby said curvature changes between said first portion and said intermediate portion, said intermediate portion intersecting said first substantially straight portion at a first intersection point defined by said change in said curvature between said first portion and said intermediate portion;

a tab having a liftable heel portion and a tab nose portion, said tab being fastened to said can end wall at a location that is intermediate said heel portion and said tab nose portion, said tab nose portion being positioned to apply downward pressure to said panel at a pressure point on said displaceable panel when said heel portion is lifted, said tab having a center line that is coincident with a radius of said can end wall;

wherein said pressure point is located a distance $D_5$, taken along a line that is perpendicular to said centerline, from said first intersection point and wherein $D_5$ is within the range of 0.040 inches to about 0.100 inches; and a fold line about which said panel folds with respect to said can end wall during opening, said fold line being positioned so that said panel folds within a plane that is oriented at an angle β with respect to said centerline, and wherein the angle β is within the range of about 60 degrees to about 90 degrees.

25. A can end according to claim 24, wherein said intermediate portion of said score line has a substantially constant radius of curvature.

26. A can end according to claim 24, wherein said main portion of said score line comprises a first section having a first radius of curvature, and wherein said intermediate portion has a second radius of curvature, and wherein said second radius of curvature is less than said first radius of curvature.

27. A can end according to claim 24, wherein said intermediate portion of said score line is tangent to said first portion of said score line at said first intersection point.

28. A can end according to claim 24, wherein said score line has a substantially constant depth.

29. A can end according to claim 24, wherein said angle β is further within the range of about 60 degrees to about 85 degrees.

30. A can end according to claim 29, wherein said angle β is about 80 degrees.

31. A can end according to claim 24, wherein the distance $D_5$ is within the range of about 0.050 inches to about 0.100 inches.

32. A can end according to claim 31, wherein the distance $D_5$ is about 0.083 inches.

33. A can end having an improved pour-type opening, comprising:

a can end wall;

a rupturable score line having a varying curvature formed in said can end wall so as to define a displaceable panel that forms said opening when said score line is ruptured, said score line comprising (i) an initial portion, (ii) a main section that terminates at a final point, said main section comprising a first portion having a first curvature, and (iii) an intermediate portion that extends from said initial portion to said first portion of said main section, said intermediate portion having a second curvature, said first curvature being different from said second curvature whereby said curvature of said score line changes between said first portion of said main section and said intermediate portion, at least one of said first and second curvatures being defined by a radius of curvature that is constant throughout its respective portion, said intermediate portion intersecting said first portion of said main section at a first intersection point defined as the point at which said curvature changes from said first curvature to said second curvature;

a tab having a liftable heel portion and a tab nose portion, said tab being fastened to said can end wall at a location that is intermediate said heel portion and said tab nose portion, said tab nose portion being positioned to apply downward pressure to said panel at a pressure point on said displaceable panel when said heel portion is lifted, said tab having a center line; and wherein said pressure point is positioned a distance $D_4$, taken in the direction of said center line, from said first intersection point, and wherein the distance $D_4$ is no greater than about 0.025 inches.

34. A can end according to claim 33, wherein said first curvature is less curved than said second curvature.

35. A can end according to claim 33, wherein said initial portion of said score line is substantially straight.

36. A can end according to claim 33, wherein said intermediate portion of said score line has a substantially constant radius of curvature.

37. A can end according to claim 33, wherein both said first portion of said main section of said score line and said intermediate portion of said score line have a substantially constant radius of curvature.

38. A can end according to claim 33, wherein said intermediate portion of said score line is tangent to said first portion of said main section of said score line at said first intersection point.

39. A can end according to claim 33, wherein said score line has a substantially constant depth.

40. A can end according to claim 33, wherein said rupturable score line is an outer score line, and further comprising an inner score line encircled by said outer score line.

41. A can end according to claim 40, wherein said inner and outer score lines are displaced from each other, and wherein the distance $D_4$ from said pressure point to said first intersection point is less than the distance by which said inner and outer score lines are displaced.

* * * * *